US008555535B1

(12) United States Patent
Watson

(10) Patent No.: US 8,555,535 B1
(45) Date of Patent: Oct. 15, 2013

(54) TRAFFIC SIGN HOLDER AND METHOD OF USE

(76) Inventor: Ted J. Watson, Castaic, CA (US)

( * ) Notice: Subject to any disclaimer, the term of this patent is extended or adjusted under 35 U.S.C. 154(b) by 0 days.

(21) Appl. No.: 13/136,790

(22) Filed: Aug. 10, 2011

(51) Int. Cl.
*G09F 15/00* (2006.01)

(52) U.S. Cl.
USPC ..... 40/612; 40/610; 40/611.08

(58) Field of Classification Search
USPC ..... 40/607.03, 610, 611.06, 611.13, 612, 40/616, 611.07; 248/463, 150
See application file for complete search history.

(56) References Cited

U.S. PATENT DOCUMENTS

| | | | | | |
|---|---|---|---|---|---|
| 2,062,479 | A * | 12/1936 | Ritz-Woller | ..... | 40/610 |
| 2,090,157 | A * | 8/1937 | Smith | ..... | 40/610 |
| 3,557,479 | A * | 1/1971 | Allison | ..... | 40/610 |
| 4,038,769 | A * | 8/1977 | Werner | ..... | 40/610 |
| 4,309,836 | A * | 1/1982 | Knapp | ..... | 40/602 |
| 5,095,642 | A * | 3/1992 | George et al. | ..... | 40/610 |
| 6,966,136 | B2 * | 11/2005 | Connors | ..... | 40/605 |
| 7,013,590 | B1 * | 3/2006 | Bell et al. | ..... | 40/610 |
| 7,164,352 | B2 * | 1/2007 | Nelson | ..... | 340/472 |
| 7,325,345 | B2 * | 2/2008 | Hailo | ..... | 40/610 |
| 2005/0108911 | A1 * | 5/2005 | Perelli et al. | ..... | 40/610 |
| 2007/0011928 | A1 * | 1/2007 | Wang | ..... | 40/612 |

* cited by examiner

*Primary Examiner* — Joanne Silbermann
*Assistant Examiner* — Christopher e Veraa
(74) *Attorney, Agent, or Firm* — Ted Masters

(57) ABSTRACT

A traffic sign holder includes a first side for night use and an opposite second side for day use. Both sides of the traffic sign holder removably accept traffic signs which contain traffic control instructions. The first side contains a selectively energizable light and at least one reflector. The second side also includes at least one reflector, and is colored a bright color. Two base members are pivotally connected to the bottom of the traffic sign holder, and are selectively positionable to a locked extended position for placement on the surface of a road, and to a collapsed position for storage. Weights can be selectively connected to the traffic sign holder to provide stability.

3 Claims, 11 Drawing Sheets

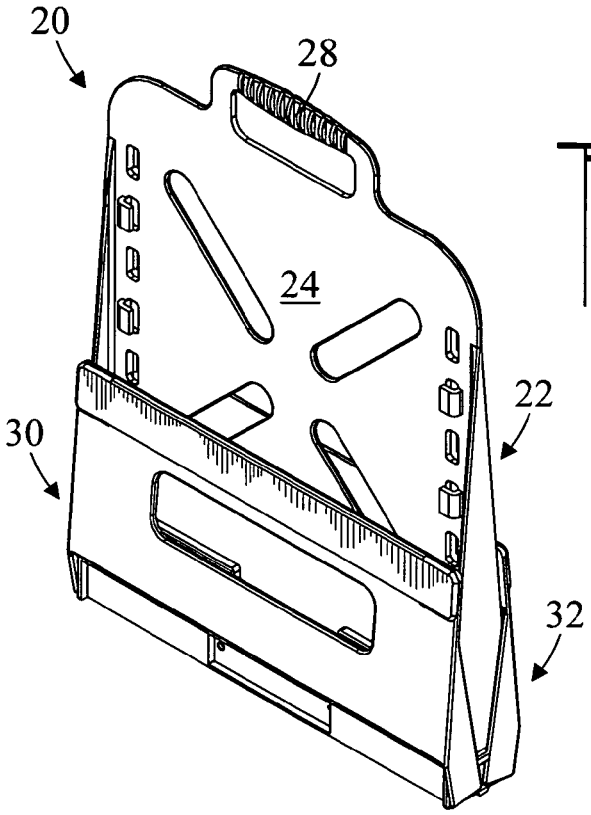
Fig. 9
Fig. 10
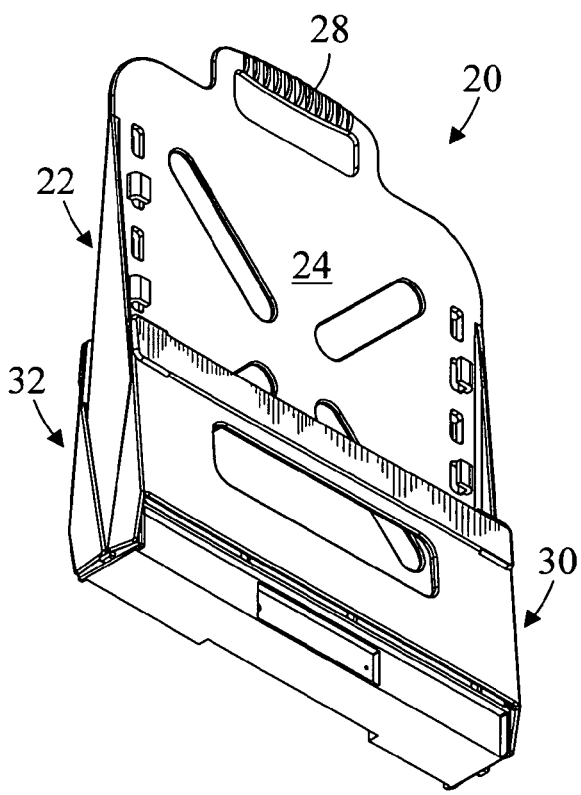

Fig. 22
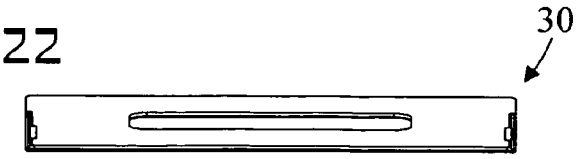
Fig. 23
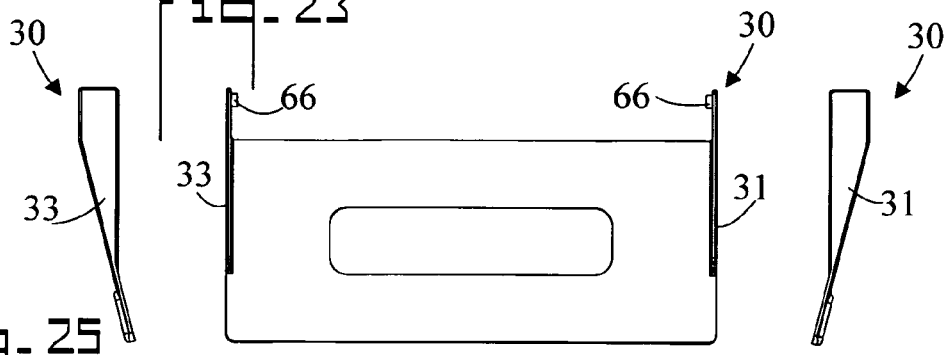
Fig. 25
Fig. 26
Fig. 24
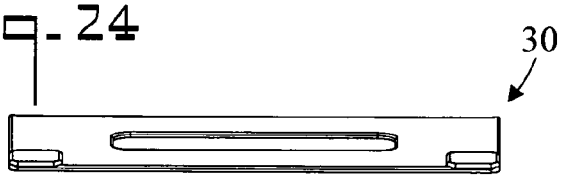
Fig. 27
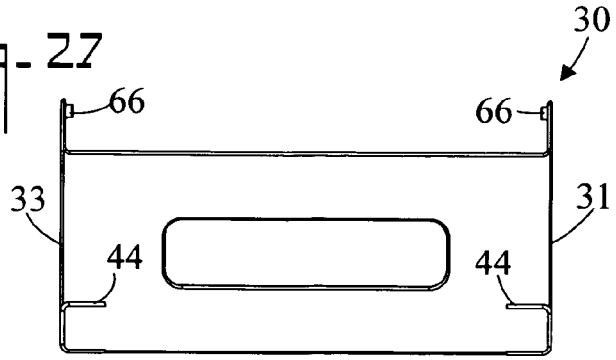
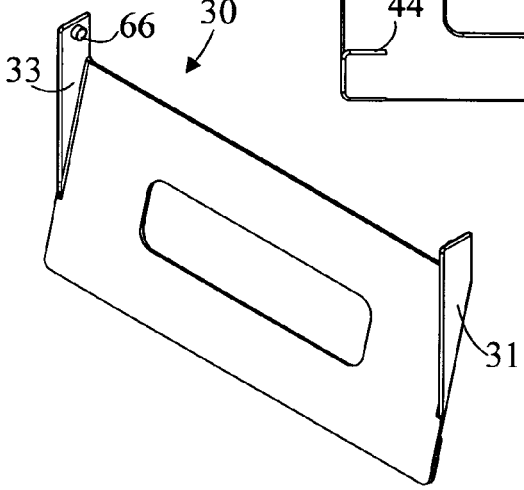
Fig. 28

TRAFFIC SIGN HOLDER AND METHOD OF USE

CROSS REFERENCE TO RELATED APPLICATION

None

TECHNICAL FIELD

The present invention pertains generally to traffic control, and more particularly to a traffic sign holder which may be rapidly deployed by law enforcement personnel.

BACKGROUND OF THE INVENTION

It is common practice for law enforcement officers to carry highway flares and or orange traffic cones in their police vehicles, typically sedans and motorcycles. The trunk of the sedan is used to store and transport both the flares and the cones, however the limited cargo space of motorcycle saddle bags can only accommodate the flares. Slow burning red pyrotechnic highway flares are recognized internationally as an established means for law enforcement officers to guide or direct motor vehicles, bicycles, pedestrians, and aircraft. However, these devices have numerous disadvantages such as: they have a limited shelf life; they are susceptible to moisture damage; they are highly flammable and therefore can cause accidental burns; they emit hazardous materials and noxious fumes of strontium nitrate, potassium perchlorate, and sulfur into the environment; they can ignite oil, gasoline, or even vegetation at the site of an accident; they can inadvertently ignite in a police vehicle causing damage, injuries, and death; once lit, they are difficult to extinguish; they have a short life and can therefore burn out when they are still needed thereby requiring replacement; they leave a toxic residue which can contaminate water supplies and drainage systems; they are not reusable and, they can be used by unlawful parties to start fires. In view of the aforementioned disadvantages, there is needed a traffic control device which will accomplish the same function, but which does not possess the many objectionable features of the conventional highway flare.

BRIEF SUMMARY OF THE INVENTION

The present invention is directed to a traffic sign holder which is temporarily placed upon a road or other thoroughfare for the purpose of directing vehicular or pedestrian traffic. The traffic sign holder removably accepts traffic signs which contain traffic control instructions (e.g. POLICE ONLY, STOP, SLOW, 5 MPH, GO LEFT, etc). The traffic sign holder has a unibody impact resistant design with a first "night" side which has reflectors and a red light, and a second "day" side which is a bright color such as international orange. Both the first and second sides of the traffic sign holder can receive traffic signs. The shape and size of the traffic sign holder is specifically designed to fold flat making it desirable for law enforcement vehicles with limited trunk space. The removable traffic signs can be printed with official law enforcement traffic control sign indicia, but can also contain any indicia which is useful in controlling vehicular or pedestrian traffic in other venues such as fire scenes, crime scenes, special events, concerts, sporting events, airports, theme parks, and the like.

The first side of the traffic sign holder has a set of reflectors which reflect the headlights of an oncoming vehicle. The first side also includes a battery powered light and a plurality of traffic sign holding stations which removably accept and hold a traffic sign. The second side also has a set of reflectors, a plurality of traffic sign holding stations, and is colored a bright color so that it will be noticed in daylight.

The traffic sign holder when used in conjunction with an official traffic control sign, both (1) provides a visual warning to approaching motorists or pedestrians, and (2) instructs the motorists or pedestrians as to what must be done (e.g. POLICE STOP, GO LEFT, KEEP OUT, POLICE ONLY, etc.). A road flare on the other hand only provides a visual warning, and does not convey any instructional information to the motorists or pedestrains.

In accordance with an embodiment of the invention, a traffic sign holder for holding a traffic sign includes a body having a first side, an opposite second side, a top end, and an opposite bottom end. A handle is disposed at the top end. A first base member is pivotally connected to the bottom end, the first base member being selectively positionable to (1) an extended position projecting outwardly from the first side, and to (2) a collapsed position folded against the first side. A second base member is pivotally connected to the bottom end, the second base member being selectively positionable to (1) an extended position projecting outwardly from the second side, and to (2) a collapsed position folded against the second side. The first side includes a plurality of sign holding stations which are shaped and dimensioned to removably receive the traffic sign, and the second side also includes a plurality of sign holding stations which are shaped and dimensioned to removably receive the traffic sign.

In accordance with another embodiment, the body includes a planar member which has a first side edge and an opposite second side edge. A first triangular flange is disposed on the first side edge of the planar member, the first triangular flange having a base. A second triangular flange is disposed on the second side edge of the planar member, the second triangular flange having a base. The first base member is pivotally connected between the base of the first triangular flange and the base of the second triangular flange. The second base member is pivotally connected between the base of the first triangular flange and the base of the second triangular flange.

In accordance with another embodiment, a locking member is disposed at the base of the first triangular flange. The locking member locking the first and second base members in the extended position.

In accordance with another embodiment, the first base member has a first side flange and an opposite second side flange. The second base member has a first side flange and an opposite second side flange. In the extended position, the locking member abuts the first side flange of the first base member and the first side flange of the second base member.

In accordance with another embodiment, the traffic sign has a width. The first plurality of sign holding stations includes (1) a first column of vertically spaced apart channel-shaped guides, and (2) a second column of vertically spaced apart channel-shaped guides. The first column of vertically spaced apart channel-shaped guides spaced apart a guide width from the second column of vertically spaced apart channel-shaped guides, the guide width being greater than the width of the traffic sign. So that the traffic sign can be slidably passed between and retained by the first column of vertically spaced apart channel-shaped guides and the second column of vertically spaced apart channel-shaped guides.

In accordance with another embodiment, the first plurality of sign holding stations is vertically offset from the second plurality of sign holding stations.

In accordance with another embodiment, a first weight is removably connectable to the first base member, and a second weight is removably connectable to the second base member.

In accordance with another embodiment, the first side includes a selectively energizable light which when energized emits a constant light.

In accordance with another embodiment, at least one reflector is disposed on the first side of the body, and at least one reflector disposed on the second side of the body.

In accordance with another embodiment, the second side of the body is a bright color.

Some other of the useful features of the traffic sign holder are:

It is reusable and is always available for redeployment.

The reflectors and light give the traffic sign holder the appearance of a road flare to approaching nighttime traffic.

Its unibody design is impact resistant and can withstand being struck or run over by a motor vehicle.

It can be weighted down with rectangular weights so that it will stay in place on windy days.

It is designed to collapse but not break when struck by a motor vehicle.

The reflectors and light are protected from damage by flanges located on the body and base members of the traffic sign holder.

The traffic sign holding stations allow a traffic sign to be easily installed and removed for the holder.

Other possible embodiments, in addition to the possible embodiments enumerated above, will become apparent from the following detailed description, taken in conjunction with the accompanying drawings, which illustrate, by way of example, the principles of the traffic sign holder and method of use.

BRIEF DESCRIPTION OF THE DRAWINGS

FIG. 9 is a top perspective view of the traffic sign holder in a collapsed position;

FIG. 10 is a bottom perspective view of the traffic sign holder in the collapsed position;

FIG. 22 is rear elevation view of a first base member;

FIG. 23 is top plan view of the first base member;

FIG. 24 is a front elevation view of the first base member;

FIG. 25 is a side elevation view of the first base member;

FIG. 26 is an opposite side elevation view of the base member;

FIG. 27 is a bottom plan view of the first base member;

FIG. 28 is a perspective view of the base member;

DETAILED DESCRIPTION OF THE INVENTION

Figure 1:
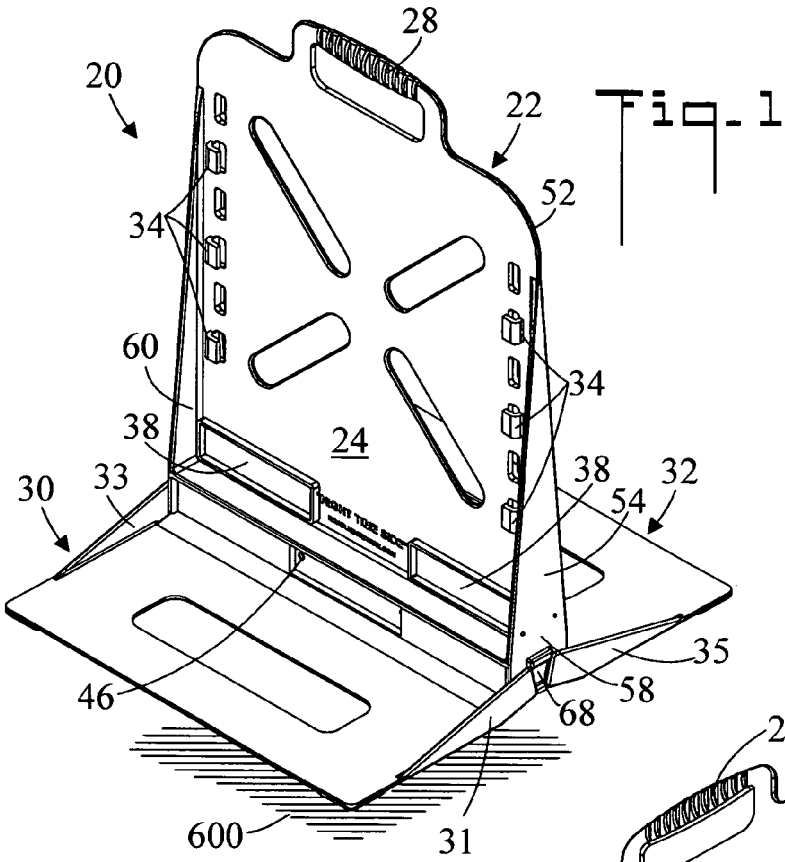
FIG. 1 is top perspective view of a traffic sign holder in an extended position.

Referring initially to FIGS. 1-8, there are illustrated top perspective, bottom perspective, top plan, first side elevation, edge elevation, second side elevation, bottom plan, and opposite edge elevation views respectively of a traffic sign holder for holding a traffic sign 500 (refer to FIGS. 30-33) generally designated as 20 in an extended position. FIGS. 9-16 are top perspective, bottom perspective, top plan, first side elevation, edge elevation, second side elevation, bottom plan, and opposite edge elevation views respectively of traffic sign holder 20 in a collapsed position. Traffic sign holder 20 includes a body 22 which has a first side 24, an opposite second side 26, a top end, and an opposite bottom end. A handle 28 for carrying and deploying traffic sigh holder 20 is disposed at the top end. Handle 28 has an axis 29. A first base member 30 is pivotally connected to the bottom end of body 22 (also refer to FIGS. 22-28). First base member 30 is selectively positionable to (1) an extended position projecting outwardly (at approximately) 90° from first side 24 (refer to FIGS. 1-8), and to (2) a collapsed (retracted) position against first side 24 (refer to FIGS. 9-16). Traffic sign holder 22 also includes a second base member 32 which is pivotally connected to the bottom end of body 22. Second base member 32 is selectively positionable to (1) an extended position projecting outwardly from second side 26, and to (2) a collapsed position against second side 26. In the shown embodiment, first base member 30 and second base member 32 are identical. First side 24 includes a plurality of sign holding stations 34 which are shaped and dimensioned to removably receive traffic sign 500 (also refer to FIG. 30). Similarly, second side 26 includes a plurality of sign holding stations 36 which are shaped and dimensioned to removably receive traffic sign 500 (also refer to FIGS. 31-33). At least one reflector 38 is disposed on first side 24 of body 22, and at least one reflector 38 is disposed on second side 26 of body 22. In the shown embodiment each side of traffic sign holder 20 has two red reflectors 38 of the many faceted lens type. In FIG. 1, traffic sign holder 20 is shown residing on the surface of a road 600. However, it may be appreciated that traffic sign holder 20 can also be placed on other support surfaces such as floors and walkways.

Figure 2:
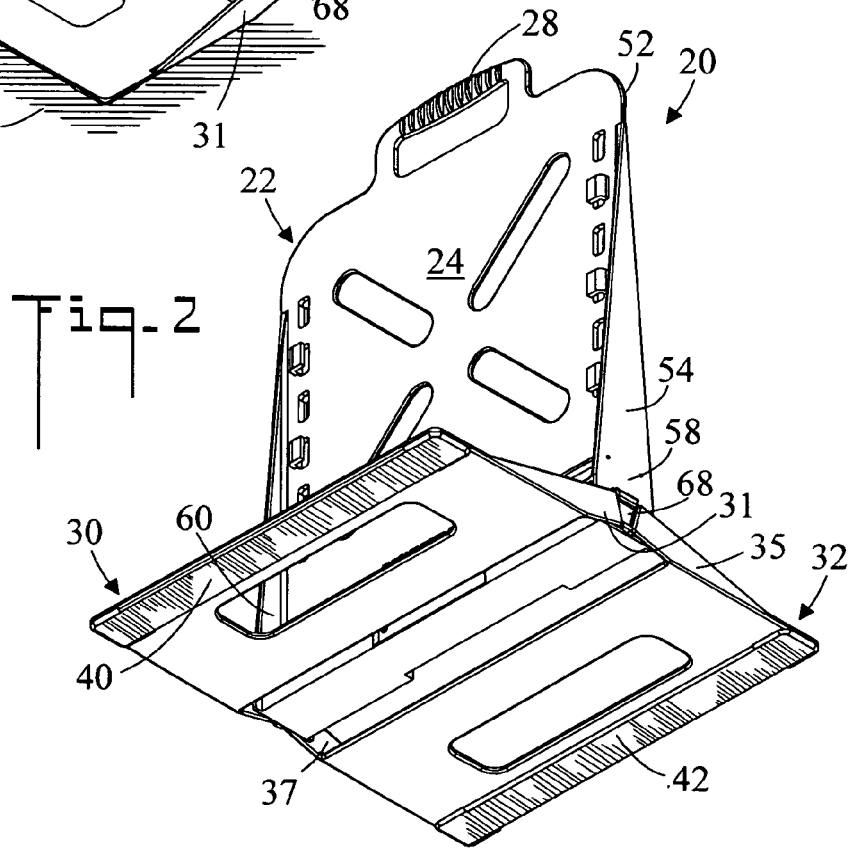
FIG. 2 is a bottom perspective view of the traffic sign holder.
Figure 3:
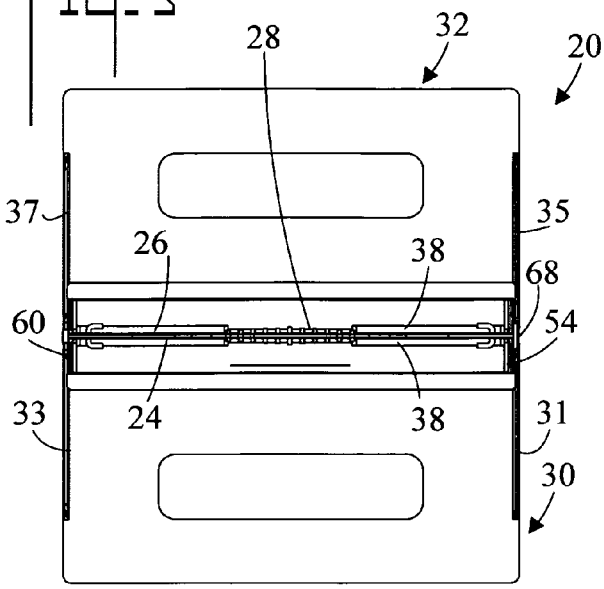
FIG. 3 is a top plan view of the traffic sign holder.
Figure 7:
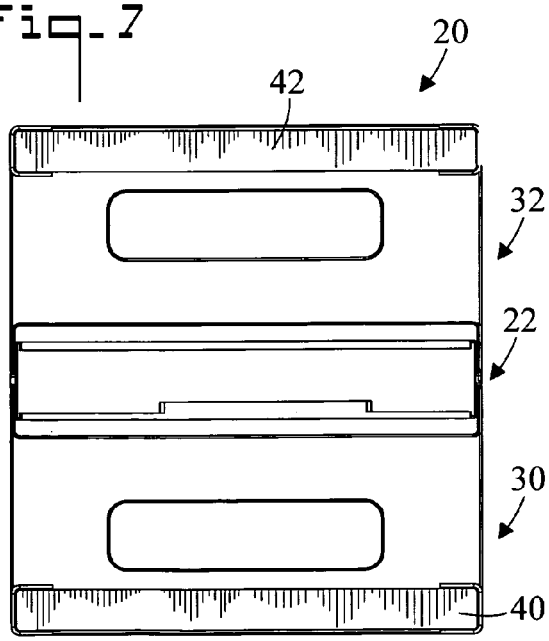
FIG. 7 is a bottom plan view of the traffic sign holder.
Figure 11:
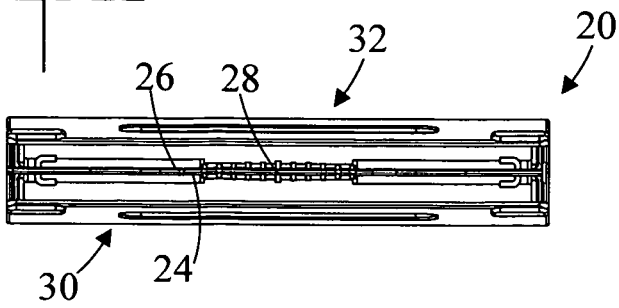
FIG. 11 is a top plan view of the traffic sign holder in the collapsed position.
Figure 12:
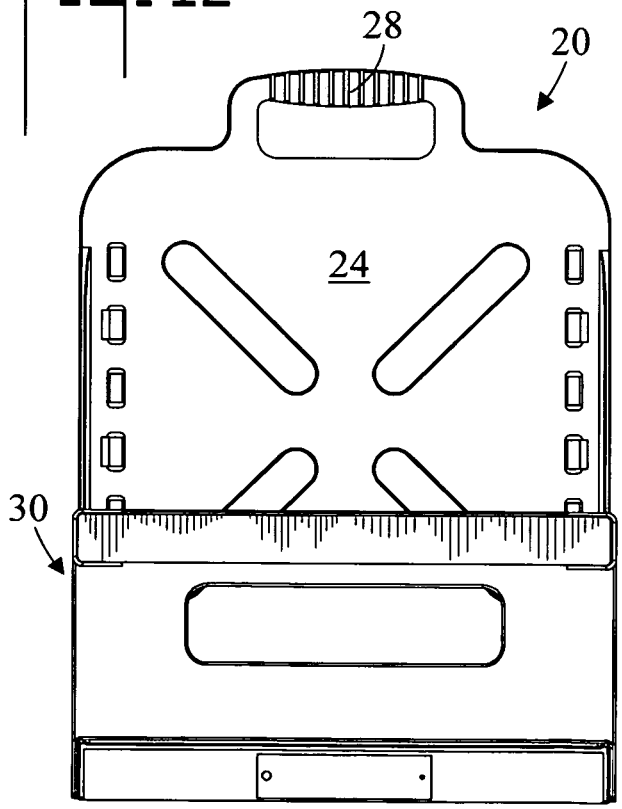
FIG. 12 is an elevation view of the first side of the traffic sign holder in the collapsed position.
Figure 13:
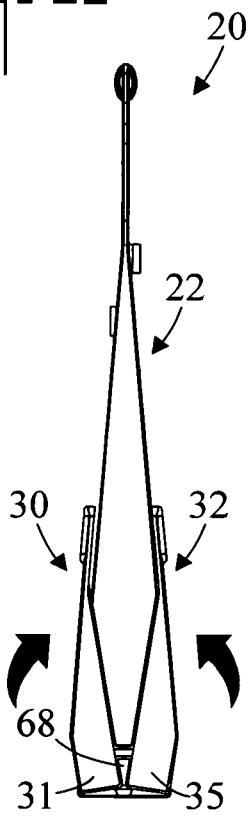
FIG. 13 is an edge elevation view of the traffic sign holder in the collapsed position.
Figure 14:
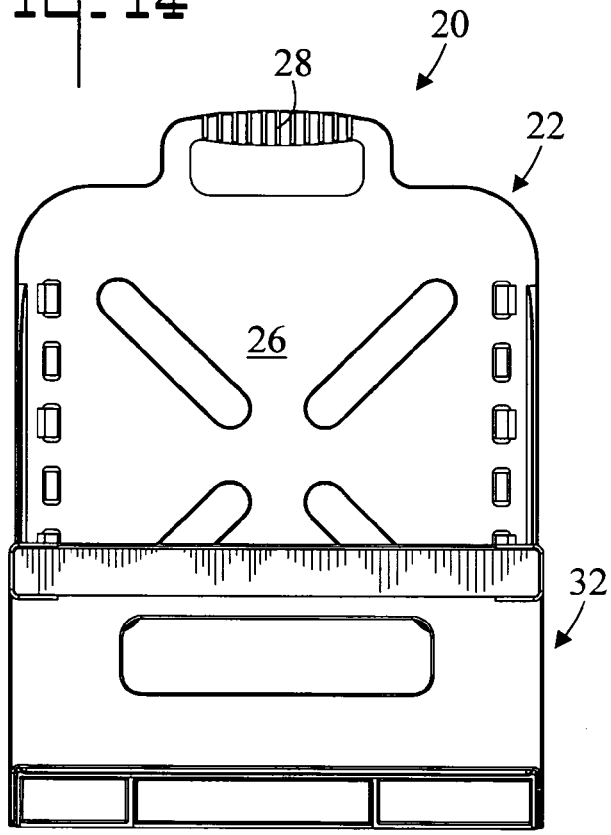
FIG. 14 is an elevation of the second side of the traffic sign holder in the collapsed position.
Figure 16:
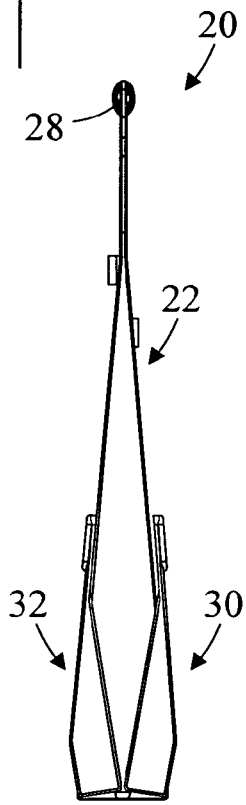
FIG. 16 is an opposite edge elevation view of the traffic sign holder in the collapsed position.
Figure 15:
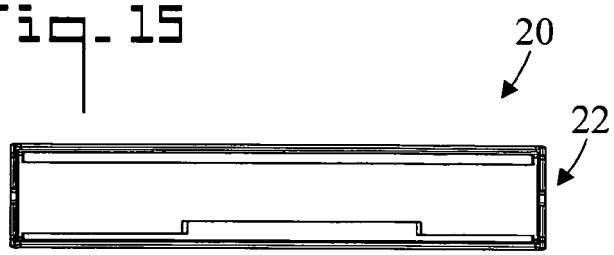
FIG. 15 is a bottom plan view of the traffic sign holder in the collapsed position.

Referring to FIGS. 2 and 7, a first weight 40 is removably connectable to first base member 30, and a second weight 42 is removably connectable to second base member. In the shown embodiment weights 40 and 42 are rectangular and made of metal, and when installed serve to stabilize traffic sign holder 20 and prevent it from tipping over (such as from wind). FIG. 27 shows first weight 40 removed from first base member 30. U-shaped weight holders 44 on first base member 30 selectively receive and hold weight 40.

Figure 4:
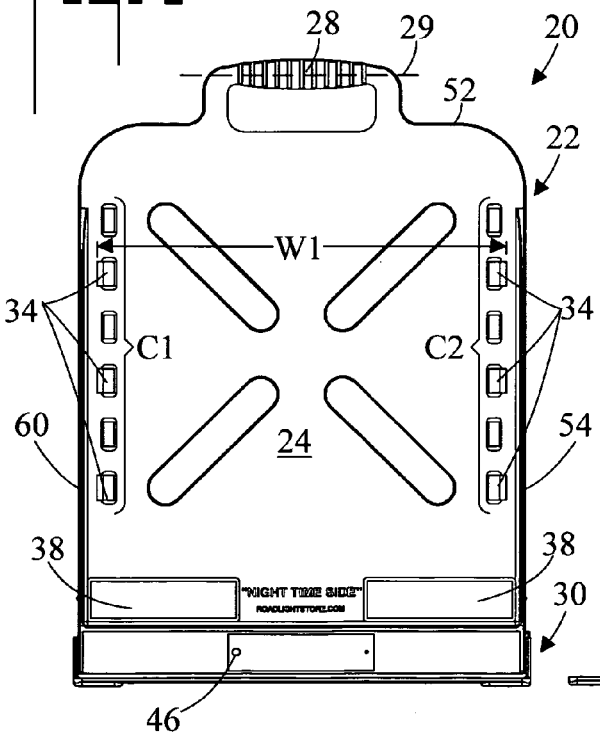
FIG. 4 is an elevation view of a first side of the traffic sign holder.
Figure 6:
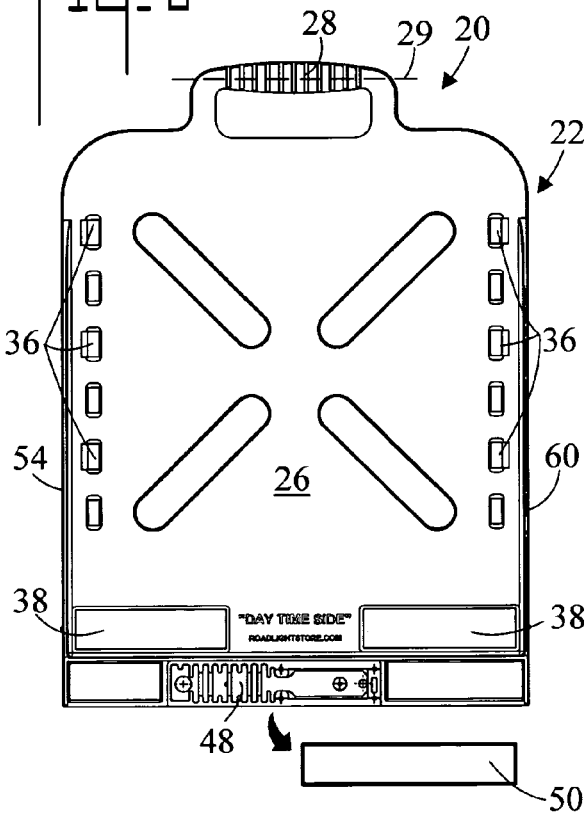
FIG. 6 is an elevation view of a second side of the traffic sign holder.
Figure 8:
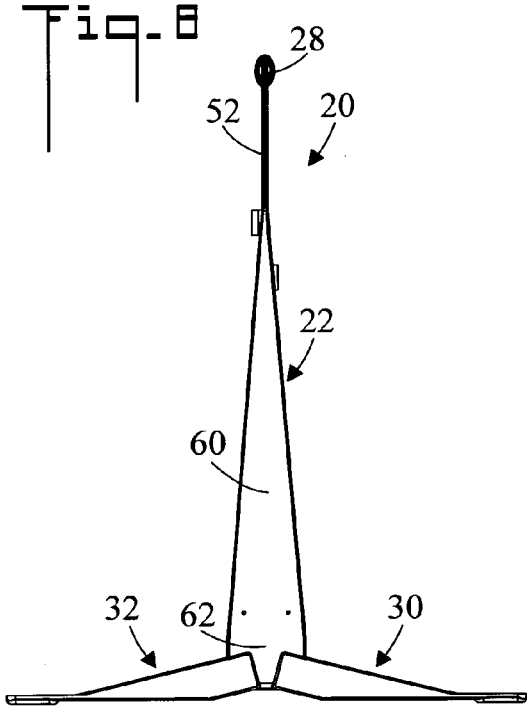
FIG. 8 is an opposite edge elevation view of the traffic sign holder.

Referring to FIGS. 1 and 4, first side 24 of traffic side holder is intended for night use and includes a selectively energizable light 46 which when energized emits a constant light. In the shown embodiment selectively energizable light 46 is a light emitting diode (LED) which is turned on and off by a switch. Referring also to FIG. 6, a battery and circuit board compartment 48 for selectively energizable light 46 is located at the bottom of second side 26, and is accessed via removable cover 50. Some people have a condition know as photosensitive epilepsy (PSE), and experience seizures triggered by visual stimuli such as flashing lights. This is the reason for the constant light (as opposed blinking or flashing) of traffic sign holder 20.

Figure 20:
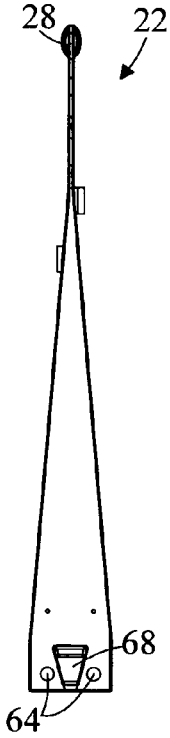
FIG. 20 is an elevation view of the first edge of the body.
Figure 18:
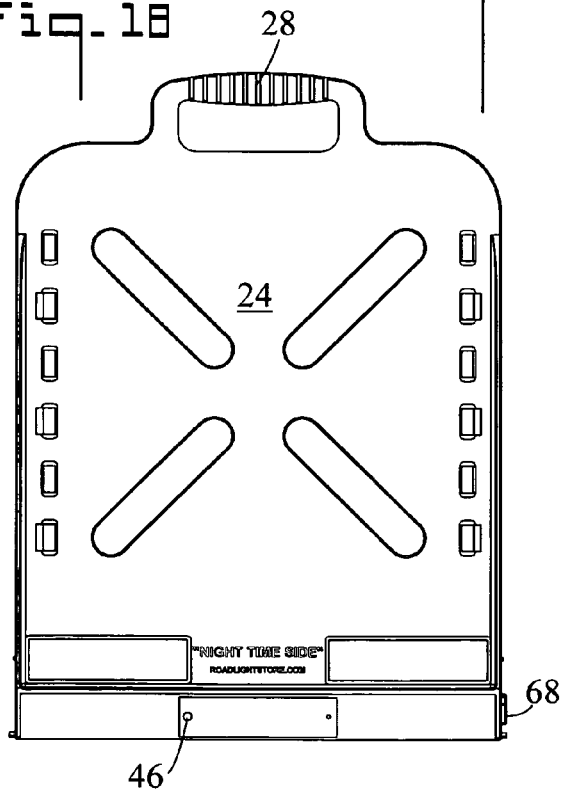
FIG. 18 is an elevation view of the first side of the body.
Figure 21:
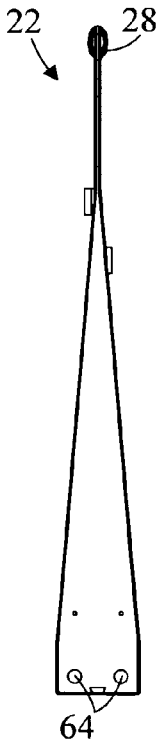
FIG. 21 is an elevation view of the second edge of the body.
Figure 19:
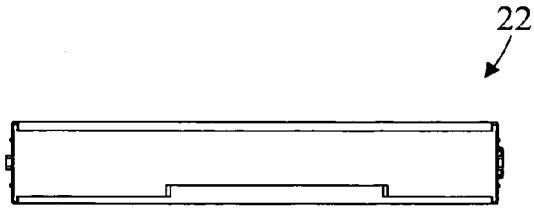
FIG. 19 is a bottom plan view of the body.

Referring to FIGS. 1-5, and 8, body 22 includes a planar member 52. Planar member has first side edge and opposite second side edge. A first triangular flange 54 is disposed on first side edge of planar member 52, first triangular flange 54 having a base 58. A second triangular flange 60 is disposed on second side edge of planar member 22, second triangular flange 60 having a base 62. First base member 30 is pivotally connected between base 58 of first triangular flange 54 and base 62 of second triangular flange 60. Similarly, second base member 32 is pivotally connected between base 58 of first triangular flange 54 and base 62 of second triangular flange 60. The pivoting action is effected by holes 64 in the base of first triangular flange 54 and second triangular flange 60 (refer to FIGS. 20 and 21), which receive posts 66 projecting from opposite sides of first base member 30 and second base member 32 (refer to FIGS. 23, 27 and 28). In addition to supporting first base member 30 and second base member 32, triangular flanges 54 and 60 serve to protect selectively energizable light 46 and reflectors 48.

Figure 5:
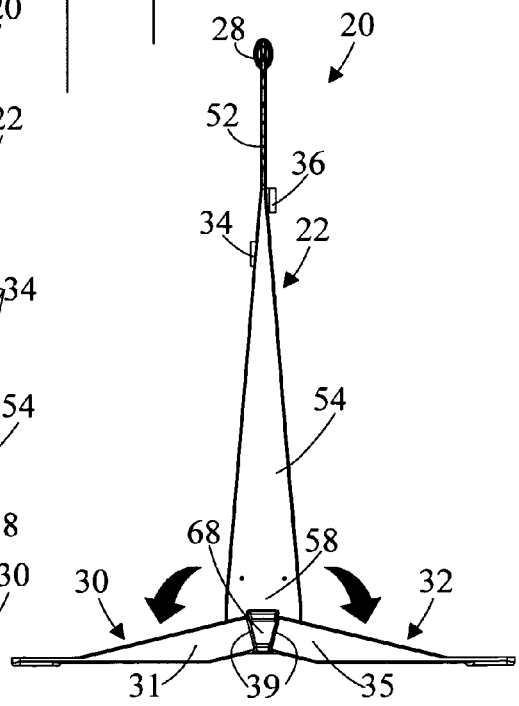
FIG. 5 is an edge elevation view of the traffic sign holder.
Figure 30:
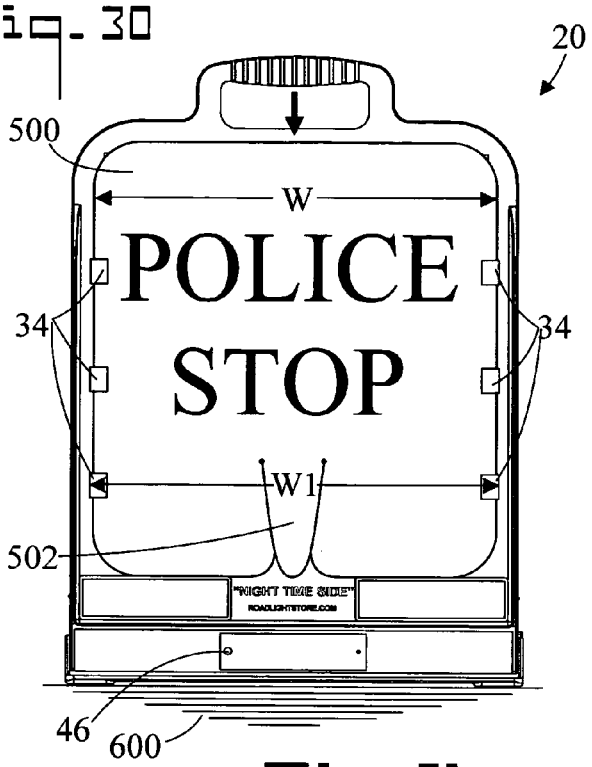
FIG. 30 is an elevation view of the traffic sign holder with a traffic sign installed in the in the first side of the holder.

Referring to FIG. 30, traffic sign 500 is planar and has a width W. Now referring to FIGS. 1, 4, and 30, first plurality 34 of sign holding stations include a first column C1 of vertically spaced apart channel-shaped guides, and (2) a second column C2 of vertically spaced apart channel-shaped guides (refer to FIG. 4). First column C1 of vertically spaced apart channel-shaped guides is spaced apart a guide width W1 from second column C2 of vertically spaced apart channel-shaped guides, wherein guide width W1 is greater than width W of traffic sign 500 (also refer to FIG. 30). So that, traffic sign 500 can be slidably passed between and retained by first column C1 of vertically spaced apart channel-shaped guides and second column C2 of vertically spaced apart channel-shaped guides. It is noted that in the shown embodiment first column C1 and second column C2 each include three spaced apart channel-shaped guides. It is also noted that second plurality 36 of sign holding stations are the same as described above for the first plurality of sign holding stations 34. As is shown in FIGS. 4-6, the first plurality of sign holding stations 34 is vertically offset from the second plurality of sign holding stations 36. In the shown embodiment, second column C2 is higher than first column C1 (refer to FIG. 5).

Figure 17:
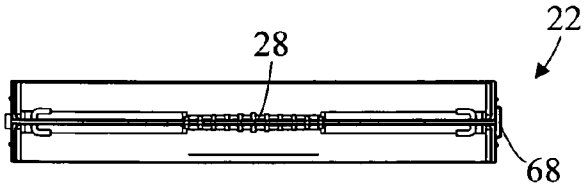
FIG. 17 is a top plan view of a body of the traffic sign holder.

Referring to FIGS. 1, 2, 5, and 20 a locking member 68 is disposed at base 58 of first triangular flange 58. Locking member 68 locks first 30 and second 32 base members in the extended position. In the shown embodiment first base member 30 has a first side flange 31 and an opposite second side flange 33, and second base member 32 has a first side flange 35 and an opposite second side flange 37 (also refer to FIGS. 23, 25-27, and 28). In the extended position locking member 68 abuts first side flange 31 or first base member 30 and first side flange 35 of second base member 32 and holds first base member 30 and second base member 32 in the extended position. In the shown embodiment locking member 68 has a trapezoidal shape the edges of which engage the edges of first side flange 31 of first base member 30 and first side flange 35 of second base member 32 (as at 39 of FIG. 5). Locking member 68 is raised from the surface of first triangular flange 54 (refer to FIG. 17). First 30 and second 32 base members are placed in the collapsed position by slightly pulling the base members away from body 22 and causing the edges of first side flanges 31 and 35 to ride up over locking member 68 (refer to FIG. 13).

Referring to FIG. 6, second side 26 of body 22 is a bright attention-drawing color such as international orange.

FIGS. 17-21 are top plan, first side elevation, bottom plan, first edge elevation, and second edge elevation views respectively of body 22 of traffic sign holder 20. Shown are body 22, first side 24, handle 28, light 46, holes 64, and locking member 68.

FIGS. 22-28 are rear elevation, top plan, front elevation, side elevation, opposite side elevation, bottom plan, and perspective views respectively of first base member 30 (second base member 32 being identical). Shown are first side flange 31, second side flange 33, U-shaped weight holders 44, and posts 66.

Figure 29:
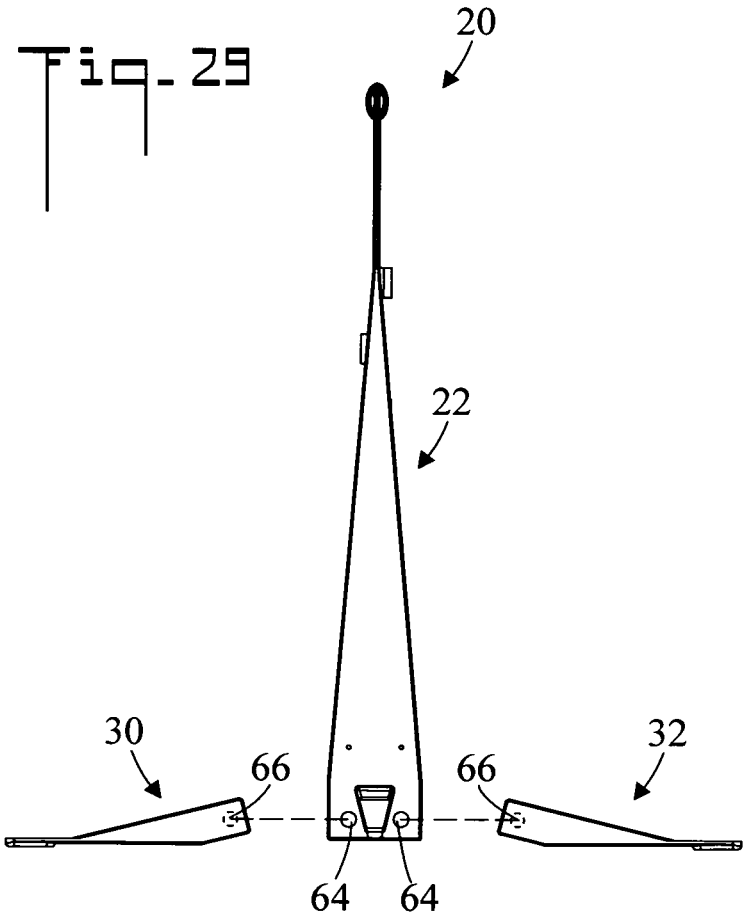
FIG. 29 is an exploded edge view of the body and first and second base members.

FIG. 29 is an exploded edge view of body 22 and first 30 and second 32 base members. First 30 and second 32 base members are pivotally connected to body 22 by placing posts 66 in holes 64.

FIG. 30 is an elevation view of traffic sign holder 20 with a traffic sign 500 installed in first side 24 of the holder. Traffic sign 500 is a planar member which is inserted into and slidably received by sign holding stations 34. Indicia on traffic sign 500 convey a message to effect traffic control. In the shown embodiment, traffic sign 500 is a conventional traffic sign which can be used with a traffic cone (not shown) by inserting a tab 502 on the sign into the open top of the traffic cone. First side 24 of traffic sign holder 20 is intended for night use, and as such traffic sign 500 is placed on first side 24 which has selectively energizable light 46.

Figure 31:
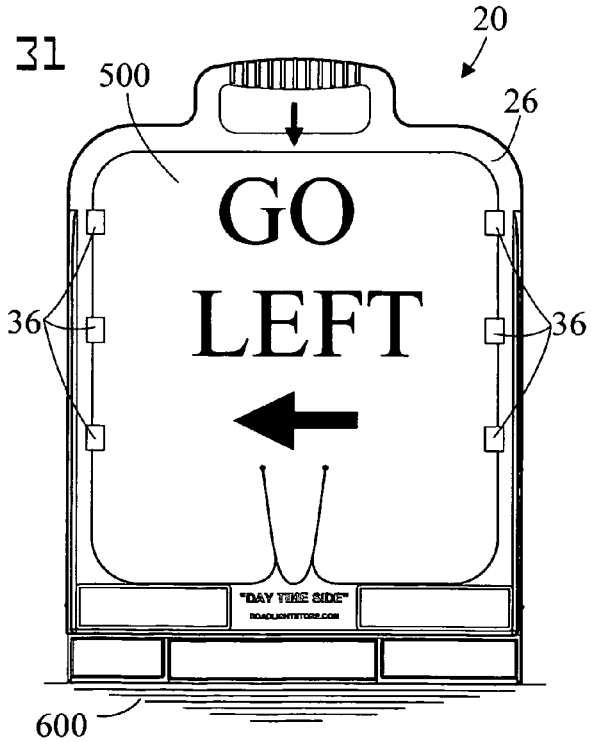
FIG. 31 is an elevation view of the traffic sign holder with a different traffic sign installed in the second side of the holder.
Figure 32:
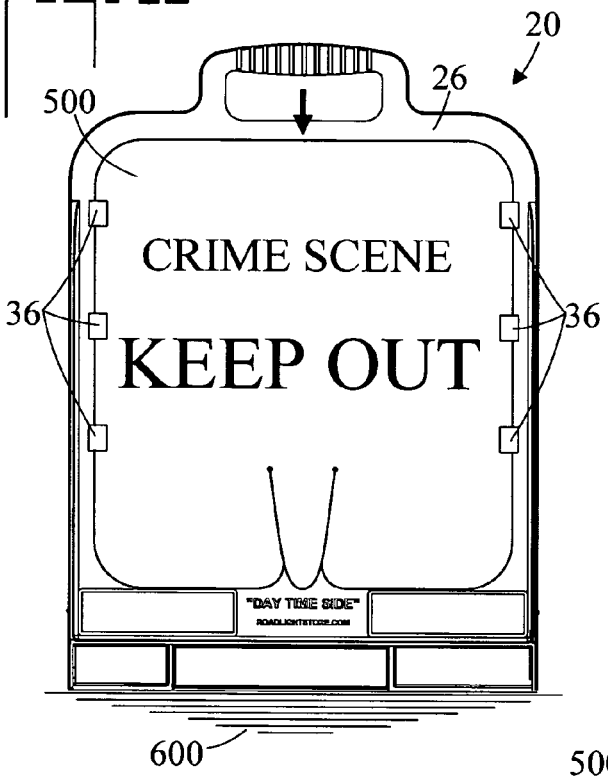
FIG. 32 is an elevation view of the traffic sign holder with a different traffic sign installed in the second side of the holder; and, FIG. 33 is an elevation view of the traffic sign holder with a different traffic sign installed in the second side of the holder.
Figure 33:
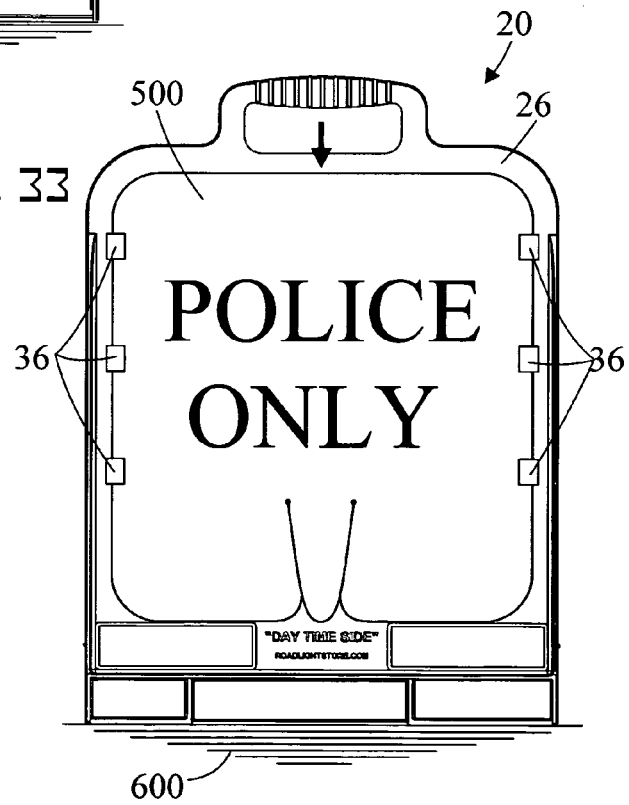

FIGS. 31-33 are elevation views of traffic sign holder 20 with different traffic signs 500 installed in second side 26, the daylight side, of the holder. Sign holding stations 36 are used to retain traffic sign 500 in traffic sign holder 20. It is noted that traffic sign holder 20 can be used to control foot traffic as well as vehicular traffic, and as such can be used indoors as well as outdoors.

In terms of use, a method for deploying a traffic sign 500 includes:

(a) providing a traffic sign 500;

(b) providing a road 600 having a surface;

(c) providing a traffic sign holder 20 for holding the traffic sign 500, the traffic sign holder 20 including;

a body 20 having a first side 24, an opposite second side 26, a top end, and an opposite bottom end;

a handle 28 disposed at the top end;

a first base member 30 pivotally connected to the bottom end, first base member 30 selectively positionable to (1)

an extended position projecting outwardly from first side 24, and to (2) a collapsed position against first side 24;

a second base member 32 pivotally connected to the bottom end, second base member 32 selectively positionable to (1) an extended position projecting outwardly from second side 26, and to (2) a collapsed position against second side 26;

first side 24 including a plurality of sign holding stations 34 which are shaped and dimensioned to removably receive traffic sign 500;

(d) inserting traffic sign 500 into the plurality of sign holding stations 34 on first side 24 of body 22;

(e) placing first 30 and second 32 base members in the extended position; and, (f) using handle 28 to place traffic sign holder 26 on the surface of road 600.

The method further including:

in step (a), providing a second traffic sign 500;

in step (c), second side 26 including a plurality of sign holding stations 36 which are shaped and dimensioned to removably receive second traffic sign 500; and, during step (d), also inserting second traffic sign 500 into the plurality of sign holding stations 36 on second side 36 of body 22.

The method further including:

in step (a), traffic sign 500 having a width W;

in step (c), first plurality of sign holding stations 34 including (1) a first column C1 of vertically spaced apart channel-shaped guides, and (2) a second column C2 of vertically spaced apart channel-shaped guides;

first column C1 of vertically spaced apart channel-shaped guides is spaced apart a guide width W1 from second column C2 of vertically spaced apart channel-shaped guides, guide width W1 being greater than width W of traffic sign 500;

so that traffic sign 500 can be slidably passed between and retained by first column C1 of vertically spaced apart channel-shaped guides and second column C2 of vertically spaced apart channel-shaped guides; and, in step (d), slidably passing traffic sign 500 between first column C1 of vertically spaced apart channel-shaped guides and second column C2 of vertically spaced apart channel-shaped guides.

The method further including:

in step (c), a first weight 40 removably connectable to first base member 30;

in step (c), a second weight 42 removably connectable to second base member 32;

prior to step (f), connecting first weight 40 to first base member 30; and, prior to step (f), connecting second weight 42 to second base member 32.

The method further including:

in step (c), first side 24 including a selectively energizable light 46 which when energized emits a constant light; and, prior to step (f), energizing energizable light 46.

The method further including:

after step (f), placing first 30 and second 32 base member is the collapsed position.

At the scene of an emergency traffic sign holder(s) 20 is removed from the trunk of the police vehicle. The appropriate traffic signs 500 are selected and inserted into the first 24 and second 26 sides. Traffic sign holder 20 is then deployed along the roadway 600 with the traffic signs 500 positioned so they are clearly visible to approaching motorist. In the event circumstances at the scene change, the officer can change out a traffic sign(s) 500. Upon completion of the incident the traffic sign holder(s) 20 are folded up and returned to the trunk of the patrol car for future use.

The possible embodiments of the traffic sign holder and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the traffic sign holder and method should be construed as limiting the invention to a particular embodiment or combination of embodiments. The scope of the invention is best defined by the appended claims.

I claim:

1. A traffic sign holder for holding a traffic sign, the traffic sign having a width, the traffic sign holder comprising:

a body having a first side, an opposite second side, a top end, and an opposite bottom end;

a handle disposed at said top end;

a first base member pivotally connected to said bottom end, said first base member selectively positionable to (1) an extended position projecting outwardly from said first side, and to (2) a collapsed position against said first side;

a second base member pivotally connected to said bottom end, said second base member selectively positionable to (1) an extended position projecting outwardly from said second side, and to (2) a collapsed position against said second side;

said first side including a first plurality of sign holding stations which are shaped and dimensioned to removably receive the traffic sign;

said second side including a second plurality of sign holding stations which are shaped and dimensioned to removably receive the traffic sign;

said first plurality of sign holding stations and said second plurality of sign holding stations each including (1) a first column of vertically spaced apart channel-shaped guides, and (2) a second column of vertically spaced apart channel-shaped guides;

said first column of vertically spaced apart channel-shaped guides spaced apart a guide width from said second column of vertically spaced apart channel-shaped guides, said guide width being greater than the width of the traffic sign;

so that the traffic sign can be slidably passed between and retained by said first column of vertically spaced apart channel-shaped guides and said second column of vertically spaced apart channel-shaped guides;

said body including a planar member having a first side edge and an opposite second side edge;

a first triangular flange disposed on said first side edge of said planar member, said first triangular flange having a base;

a second triangular flange disposed on said second side edge of said planar member, said second triangular flange having a base;

said first base member pivotally connected between said base of said first triangular flange and said base of said second triangular flange;

said second base member pivotally connected between said base of said first triangular flange and said base of said second triangular flange;

a trapezoidal-shaped locking member disposed at said base of said first triangular flange;

said locking member locking said first and second base members in said extended position;

said first base member having a first side flange and an opposite second side flange;

said second base member having a first side flange and an opposite second side flange;

in said extended position, said locking member engaging said first side flange of said first base member and said first side flange of said second base member; and, in said collapsed position said first side flange of said first base member and said first side flange of said second base member riding up over said locking member.

2. A traffic sign holder for holding a traffic sign, the traffic sign having a width, the traffic sign holder comprising:

a body having a first side, an opposite second side, a top end, and an opposite bottom end;

a handle disposed at said top end;

a first base member pivotally connected to said bottom end, said first base member selectively positionable to (1) an extended position projecting outwardly from said first side, and to (2) a collapsed position against said first side;

a second base member pivotally connected to said bottom end, said second base member selectively positionable to (1) an extended position projecting outwardly from said second side, and to (2) a collapsed position against said second side;

said first side including a first plurality of sign holding stations which are shaped and dimensioned to removably receive the traffic sign;

said second side including a second plurality of sign holding stations which are shaped and dimensioned to removably receive the traffic sign;

said first plurality of sign holding stations and said second plurality of sign holding stations each including (1) a first column of vertically spaced apart channel-shaped guides, and (2) a second column of vertically spaced apart channel-shaped guides;

said first column of vertically spaced apart channel-shaped guides spaced apart a guide width from said second column of vertically spaced apart channel-shaped guides, said guide width being greater than the width of the traffic sign;

so that the traffic sign can be slidably passed between and retained by said first column of vertically spaced apart channel-shaped guides and said second column of vertically spaced apart channel-shaped guides; and, said first plurality of sign holding stations vertically offset from said second plurality of sign holding stations.

3. A traffic sign holder for holding a traffic sign, the traffic sign having a width, the traffic sign holder comprising:

a body having a first side, an opposite second side, a top end, and an opposite bottom end;

a handle disposed at said top end;

a first base member pivotally connected to said bottom end, said first base member selectively positionable to (1) an extended position projecting outwardly from said first side, and to (2) a collapsed position against said first side;

a second base member pivotally connected to said bottom end, said second base member selectively positionable to (1) an extended position projecting outwardly from said second side, and to (2) a collapsed position against said second side;

said first side including a first plurality of sign holding stations which are shaped and dimensioned to removably receive the traffic sign;

said second side including a second plurality of sign holding stations which are shaped and dimensioned to removably receive the traffic sign;

said first plurality of sign holding stations and said second plurality of sign holding stations each including (1) a first column of vertically spaced apart channel-shaped guides, and (2) a second column of vertically spaced apart channel-shaped guides;

said first column of vertically spaced apart channel-shaped guides spaced apart a guide width from said second column of vertically spaced apart channel-shaped guides, said guide width being greater than the width of the traffic sign;

so that the traffic sign can be slidably passed between and retained by said first column of vertically spaced apart channel-shaped guides and said second column of vertically spaced apart channel-shaped guides;

said body including a planar member having a first side edge and an opposite second side edge;

a first triangular flange disposed on said first side edge of said planar member, said first triangular flange having a base;

a second triangular flange disposed on said second side edge of said planar member, said second triangular flange having a base;

said first base member pivotally connected between said base of said first triangular flange and said base of said second triangular flange;

said second base member pivotally connected between said base of said first triangular flange and said base of said second triangular flange;

a trapezoidal-shaped locking member disposed at said base of said first triangular flange;

said locking member locking said first and second base members in said extended position;

said first base member having a first side flange and an opposite second side flange;

said second base member having a first side flange and an opposite second side flange;

in said extended position, said locking member engaging said first side flange of said first base member and said first side flange of said second base member;

in said collapsed position said first side flange of said first base member and said first side flange of said second base member riding up over said locking member;

said first plurality of sign holding stations vertically offset from said second plurality of sign holding stations;

a first weight removably connectable to said first base member;

a second weight removably connectable to said second base member;

said first side including a selectively energizable light which when energized emits a constant light;

said handle having an axis, said axis oriented perpendicular to said first and second columns of vertically spaced apart channel-shaped guides;

at least one reflector disposed on said first side of said body, said energizable light and said at least one reflector giving said traffic sign holder the appearance of a road flare to approaching nighttime traffic;

at least one reflector disposed on said second side of said body; and, said second side of said body being a bright color.

* * * * *